US006218927B1

(12) United States Patent
Segal

(10) Patent No.: US 6,218,927 B1
(45) **Date of Patent: *Apr. 17, 2001**

(54) STACKED MAGNETIC TRANSFORMER CORE WITH CENTER LEG CURVILINEAR S-JOINTS

(75) Inventor: Vladimir Segal, Livingston, NJ (US)

(73) Assignee: ABB Power T&D Company Inc., Raleigh, NC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/251,289

(22) Filed: Feb. 17, 1999

(51) Int. Cl.[7] ..... H01F 27/24

(52) U.S. Cl. ..... 336/216; 336/217; 336/212; 336/234

(58) Field of Search ..... 336/216, 217, 336/234, 212

(56) References Cited

U.S. PATENT DOCUMENTS

| | | | | |
|---|---|---|---|---|
| 511,574 | * | 12/1893 | Wood | 336/217 |
| 536,608 | * | 4/1895 | Dickerson | 336/217 |
| 970,587 | * | 9/1910 | Wiemer | 336/217 |
| 2,300,964 | | 11/1942 | Putman | 175/356 |
| 3,210,708 | | 10/1965 | Franklin et al. | 336/217 |
| 3,587,020 | | 6/1971 | Waasner | 336/212 |
| 3,743,991 | | 7/1973 | Gumpper et al. | 336/217 |
| 3,793,129 | | 2/1974 | Doggart et al. | 161/49 |
| 3,895,336 | * | 7/1975 | Pitman | 336/217 |
| 4,149,136 | | 4/1979 | Philberth et al. | 336/217 |
| 4,158,186 | | 6/1979 | Philberth et al. | 336/217 |
| 4,200,854 | | 4/1980 | De Laurentis et al. | 336/217 |
| 4,521,957 | | 6/1985 | McLeod | 29/609 |
| 4,827,237 | | 5/1989 | Blackburn | 336/212 |
| 4,897,916 | | 2/1990 | Blackburn | 29/609 |
| 5,047,745 | | 9/1991 | Marriott et al. | 310/217 |

* cited by examiner

*Primary Examiner*—Anh Mai
(74) *Attorney, Agent, or Firm*—Woodcock Washburn Kurtz Mackiewicz & Norris

(57) ABSTRACT

A stacked magnetic transformer core is disclosed with center leg curvilinear S-joints for reducing losses and for minimizing waste or scrap material during the manufacture of the laminations.

5 Claims, 2 Drawing Sheets

12
20
22
14a
22a
22b
16a
14
16
18

18
14a
14

20
16a
16

22
22a
22b

STACKED MAGNETIC TRANSFORMER CORE WITH CENTER LEG CURVILINEAR S-JOINTS

BACKGROUND OF THE INVENTION

1. Field of the Invention

This invention relates in general to magnetic core structures and, more specifically to laminated magnetic transformer core structures having center leg curvilinear S-joints.

2. Description of the Prior Art

Stacked magnetic cores for large electrical power transformers of the core-form type conventionally use the butt-lap type of joint disclosed in U.S. Pat. No. 2,300,964. In the butt-lap joint the ends of the leg and the yoke laminations are mitred and butted together to form diagonal joints between the laminations, in each layer of laminations. In principal, the joints and alternate layers are aligned and offset from aligned joints and the intervening layers. In practice to reduce handling, the joints in three adjacent layers of laminations are usually aligned, and the joints in the next three adjacent layers are aligned, but offset from the joints of the adjacent group of three laminations. While the butt-lap construction can form a good magnetic surface, it has disadvantages. One is the great care with which laminations must be stacked in order to optimize magnetic performance. Another disadvantage is the amount of power loss at the joints which increases the excitation current required and increases the sound level.

Laminated magnetic step-lap transformer cores are also well known in the art. Step-lap joints and transformers reduce core losses, reduce the excitation current requirements, and reduce the sound level, compared with a similarly rated transformer constructed with a butt-lap joint. In a step lap joint, the joints created by the abutting laminations of each layer are successively offset in succeeding layers in the same direction to create at least three "steps" and preferably at least six or seven, before the step pattern is repeated. An example of transformer cores with step-lap joints is disclosed in U.S. Pat. No. 4,200,854. While such prior art cores with step-lap joints improve the magnetic properties of the core, they have left something to be desired in the way of minimizing scrap saving in their construction.

Accordingly, it would be desirable and it is an object of this invention, to provide a laminated magnetic step-lap transformer core with center leg curvilinear S-joints which may be fabricated from less material than present state of the art cores. It is a further object of this invention to improve the no-load performance of a transformer, to lower the cost and to increase the productivity of core manufacturing.

SUMMARY OF THE INVENTION

This invention discloses a new and improved arrangement for constructing a stacked magnetic core for a transformer. A novel arrangement is provided for the middle leg lamination geometry to provide a curvilinear S-joint between the middle leg and the yoke laminations. The present invention also provides cutting sequences of laminations to ensure most efficient steel usage.

In accordance with one aspect of the invention there is provided in a stacked magnetic core for a transformer, the core including a plurality of layers of magnetic laminations, each lamination including an upper yoke element, a lower yoke element, a central leg element interconnecting the upper and lower yoke elements and a pair of outer leg elements interconnecting the opposite ends of the yoke elements, the improvement in the core lamination geometry to improve the conditions for magnetic flux transfer across the joint areas wherein the ends of the center leg element have a curvilinear S-shape configuration with interfits with a complementary curvilinear S-shape configuration intermediate the ends of the yoke elements to form curvilinear S-joints therebetween, said ends of said center leg element being of reverse configuration, and the ends of the yoke elements and the ends of the pair of outer leg elements are cut at an angle so as to form step-lap mitre joints in the corners of the core when assembled with each other. Further in accordance with the invention the core is stacked with no more than three laminations per layer and the orientation of the curvilinear S-joints is altered in the even and odd layers of the core.

In accordance with a further aspect of the invention, the core includes at least one group of the layers of magnetic laminations, each group includes a plurality of the layers of magnetic laminations, the upper yoke elements of each layer of laminations in each group being shifted longitudinally in one direction so that the step lap mitre ends overlap a predetermined distance, and the lower yoke elements of each layer of laminations in each group being shifted longitudinally in the opposite direction so that the step lap mitre ends overlap a distance corresponding to the overlap distance of the layers of upper yoke elements. In a preferred form of the invention, the step lap mitre ends overlap a distance of about 2 to 20 mm.

BRIEF DESCRIPTION OF THE DRAWINGS

For a more detailed disclosure of the invention and for further objects and advantages thereof, reference is to be had to the following description taken in conjunction with the accompanying drawings.

DESCRIPTION OF THE PREFERRED EMBODIMENT

Figures 1, 2, 3, 4:
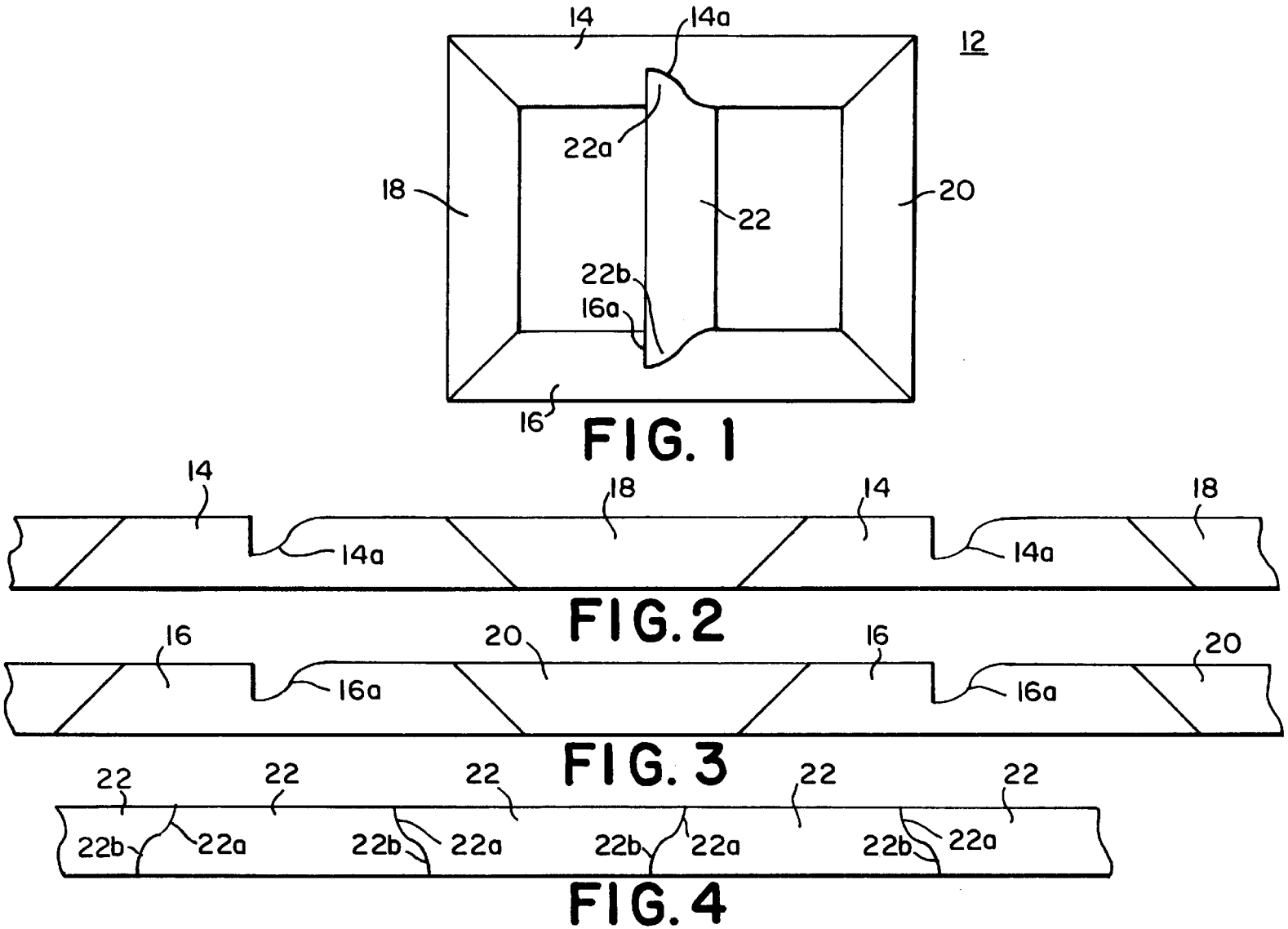
FIG. 1 is a plan view of a layer of laminations for a stacked magnetic transformer core with center leg curvilinear S-joints according to the present invention.
FIGS. 2 and 3 are plan views showing the cutting sequences of the alternate outer leg and yoke laminations for the layer of laminations shown in FIG. 1.
FIG. 4 is a plan view showing the cutting sequences of the center leg without scrap for the layer of laminations illustrated in FIG. 1.
Figure 5:
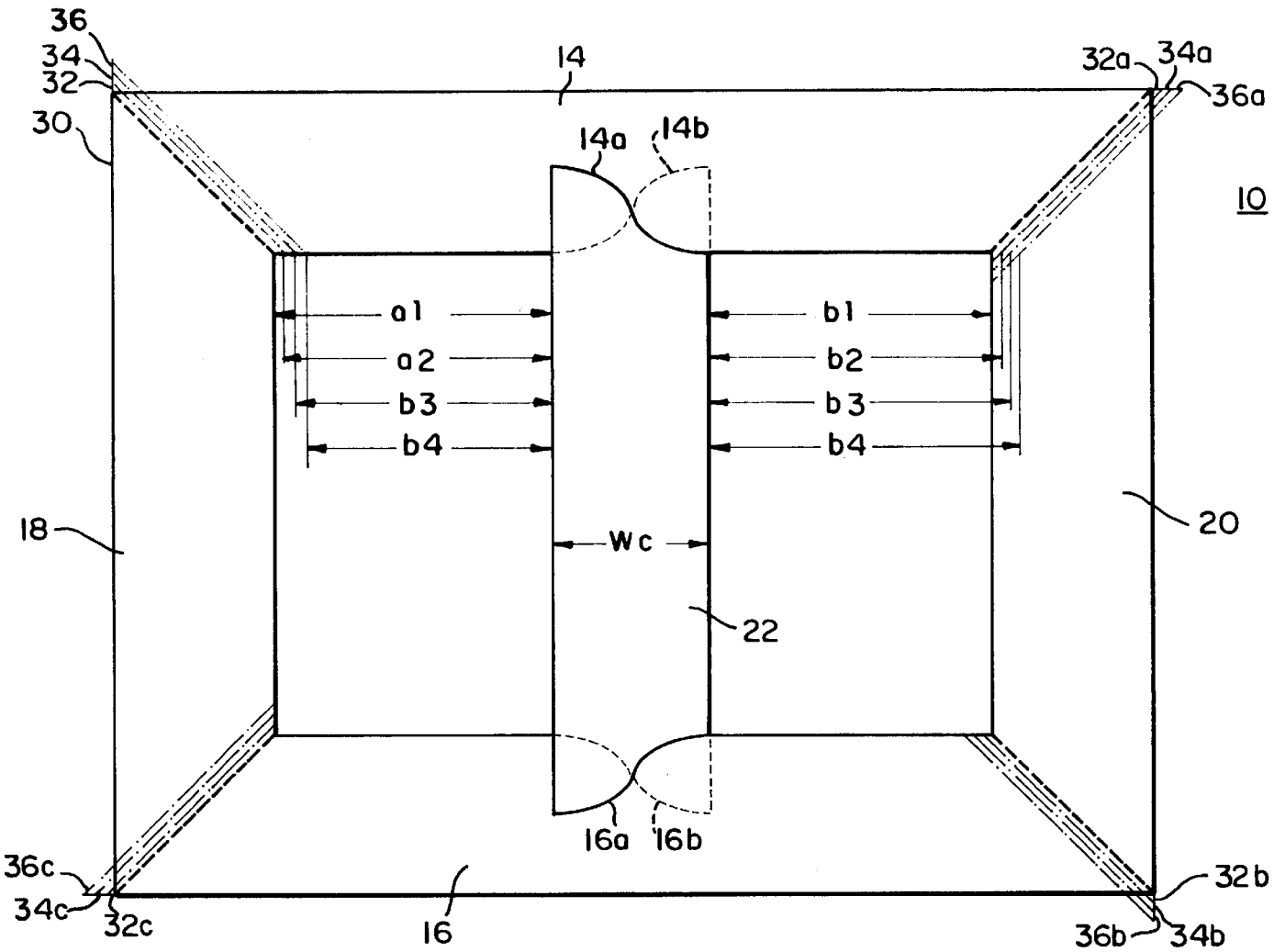
FIG. 5 is a plan view of a stacked transformer core with curvilinear S-shaped joints utilizing layers of laminations according to FIG. 1 and the lamination elements according to FIGS. 2–4 of the present invention.

Referring to FIG. 5 there is illustrated a laminated stacked transformer core 10 with curvilinear S-shaped joints in accordance with the present invention. It will be understood that each transformer core 10 is made up of a plurality of groups of layers of laminations although only one layer 12 is shown in FIG. 1 and only one group is shown in FIG. 5. Each layer of laminations 12 includes up to three laminations and the number of layers in each group will vary. In FIG. 5 the number of layers is illustrated as four but may be as high as 7 or as lower as 3. As shown in FIG. 1 each layer in the group includes an upper yoke element 14 and an identical lower yoke element 16, a pair of identical outer leg elements 18 and 20 and a center leg element 22. To ensure the most efficient steel usage, the outer limbs 18, 20 and the yokes 14, 16 of the core are cut in sequence from a single steel strip, while the center leg 22 should be cut from another strip of the same width as shown in FIGS. 2–4. While the upper and lower yokes 14 and 16 and the legs 18 and 20 have been illustrated as cut from different strips in FIGS. 1 and 2, it is to be understood that they could be all cut from the same strip and that the upper and lower yokes 14 and 16 are interchangeable as are the legs 18 and 20.

Referring now to FIG. 5 and the stacked transformer core 10, the first layer of laminations 30 is shown in solid line including the step lap mitre joints and the center curvilinear S-joint. The ends of the outer leg elements 18 and 20 and the yoke elements 14 and 16 have identically shaped edges to form the step lap mitre joints at the corners. The curvilinear S-joints are formed by the curvilinear S-shaped ends 22*a*, 22*b* on the center leg 22 which mate with the complementary curvilinear S-shaped cut 14*a* in the upper yoke 14 and the curvilinear S-shaped cut 16*a* in the lower yoke 16 as shown in FIG. 1. It will be noted that the S-shaped ends 22*a* and 22*b* on the center leg element 22 are of reverse configuration with respect to each other.

As shown in FIG. 5 the width of the center leg 22 is Wc. The inner length of the yoke 14 is equal to a1+b1+Wc and a1=b1 for the first layer 30. For the second layer 32, the yoke's curvilinear S-shaped cut 14*a* is shifted and flipped over as shown by the dotted lines to the position 14*b* in FIG. 5. This results in shifting the step lap mitre edges on the right and left ends of the yoke 14 a predetermined overlap distance, for example from 2 to 20 mm and the right upper corner of the yoke will protrude as indicated at 32*a*. Where the laminations are cut by a laser gun the "shift an flip over" are achieved at once by changing the laser gun motion to cut each layer until the whole group (up to 7 or 8 layers) is cut and the sequence is repeated. As will be seen the width of the center leg Wc is kept constant and the leg 22 itself only flips to the dotted line position 14*b* but does not shift laterally.

In the second layer of laminations 32, the dimension a2=a1−overlap and b2=b1 plus overlap, thus the inner length of the yoke 14 is kept constant. In the third layer 34, the dimension a3=a1−2×overlap and b3=b1+2×overlap. In the fourth layer, a4=a1−3×overlap and b4=b1+3×overlap, and this repeats for each additional layer of laminations.

As may be seen in FIG. 5 the layers of the left leg 18 are shifted upwards, so that its left upper corner sticks out at 32, 34 and 36 and layers of the upper yoke 14 are shifted to the right so that its right upper corner sticks out at 32*b*, 34*b* and 36*b*. The layers of the right leg 20 are shifted down so that in the right inner corner of the core triangles with no overlap are formed because there is a leg 20 but no yoke on top of it. At the left inner corner of the core a half-empty corner is formed because there is no overlap with the leg 18. The center leg 22 with the curvilinear S-shaped top 22*a* is flipped over with its side edges staying in line since the S-cut 14*a* in the upper yoke 14 is moved to the left to compensate for the yoke's shift to the right at an overlap distance from its position in the first layer. In the third layer of laminations 34 the outer leg 18 moves further up on the left and the outer leg 20 moves down on the right and the center leg 22 fully repeats its position to that in the first layer, while the S-cut 14*a* in the yoke is moved one more step to the left as described above. While the description thus far has been with regard to the movement of the upper yoke 14 in the layers 30–36, in the lower part of the core the same shifts occur with regard to the lower yoke 16 but in the opposite direction, so that the lower and upper yokes 14 and 16 are fully interchangeable as well as the left and right legs 18 and 20. Thus the corners of the layers of the right leg stick out at 32*b*, 34*b* and 36*b* and the corners of the layers of the lower yoke 16 stick out at 32*c*, 34*c* and 36*c*.

From the foregoing it will be seen that the core 10 is stacked layer by layer and alternating the orientation of the curvilinear S-shaped edges. The preferred way to produce the proposed joint geometry is by using laser cutting equipment. By changing the core lamination geometry from linear to curvilinear S-shaped, the conditions for magnetic flux transfer across the joint areas is improved. The joint geometry ensures scrapless lamination cuttings for all legs of a single and/or three phase stacked core. The core is stacked with 1 to N (typically, N should not exceed 3) laminations per layer with alternating the orientation of the curvilinear S-joint in the even and odd layers of the core. Mechanical stability of the core is increased due to improved friction in the overlap areas of the joint and due to better matching of the legs and yokes in the joints.

While a preferred embodiment of the invention has been described and illustrated it is to be understood that further modifications thereof may be made without departing from the scope and spirit of the appended claims.

What is claimed is:

1. In a stacked magnetic core for a transformer, said core comprising a plurality of layers of magnetic laminations, each lamination comprising an upper yoke element, a lower yoke element, a central leg element interconnecting said upper and lower yoke elements, and a pair of outer leg elements interconnecting the opposite ends of said yoke elements, the improvement in the core lamination geometry to improve the conditions for magnetic flux transfer across the joint areas wherein the ends of said center leg element have an curvilinear S-shaped configuration which interfits with a complementary curvilinear S-shaped configuration intermediate the ends of said yoke elements to form curvilinear S-joints therebetween, said ends of said center leg element being of reverse configuration, and the ends of said yoke elements and the ends of said pair of outer leg elements are cut at an angle so as to form step-lap mitre joints in the corners of the core when assembled with each other.

2. In a stacked core for a transformer according to claim 1 wherein said core is stacked with no more than three laminations per layer and the orientation of the curvilinear S-joints is alternated in the even and odd layers of the core.

3. In a stacked core for a transformer according to claim 2 wherein said core comprises at least one group of said layers of magnetic laminations, each said group comprising a plurality of said layers of magnetic laminations, said upper yoke elements of each layer of laminations in each group being shifted longitudinally in one direction so that the step-lap mitre ends overlap a predetermined distance and said lower yoke elements of each layer of laminations in each group being shifted longitudinally in the opposite direction so that the step-lap mitre ends overlap a distance corresponding to the overlap distance of said layers of upper yoke elements.

4. In a stacked core for a transformer according to claim 3 wherein said step-lap mitre ends overlap a distance of 2 to 20 mm.

5. In a stacked core for a transformer according to claim 1 wherein the ends of the outer leg elements and the yoke elements have identically shaped edges to form the step-lap mitre joints in the corners of the core.

* * * * *